US008430374B2

(12) United States Patent
Kurth

(10) Patent No.: US 8,430,374 B2
(45) Date of Patent: Apr. 30, 2013

(54) CEILING FORMWORK HAVING SUPPORTING MEANS FOR FORMWORK PANELS

(75) Inventor: Bernd Kurth, Haslach i. K. (DE)

(73) Assignee: Paschal-Werk G. Maier GmbH, Steinach (DE)

( * ) Notice: Subject to any disclaimer, the term of this patent is extended or adjusted under 35 U.S.C. 154(b) by 573 days.

(21) Appl. No.: 12/669,980

(22) PCT Filed: Jul. 29, 2008

(86) PCT No.: PCT/EP2008/006244
§ 371 (c)(1),
(2), (4) Date: Jan. 21, 2010

(87) PCT Pub. No.: WO2009/015866
PCT Pub. Date: Feb. 5, 2009

(65) Prior Publication Data

US 2010/0193663 A1 Aug. 5, 2010

(30) Foreign Application Priority Data

Jul. 31, 2007 (DE) ..... 10 2007 036 368

(51) Int. Cl.
*E04G 11/38* (2006.01)
*E04G 11/48* (2006.01)

(52) U.S. Cl.
USPC ..... 249/18; 248/357

(58) Field of Classification Search ..... 249/18, 249/26, 27, 28; 248/357; 108/157.15, 157.17
See application file for complete search history.

(56) References Cited

U.S. PATENT DOCUMENTS 5,614,122 A * 3/1997 Schworer ..... 249/210
5,683,609 A * 11/1997 Schworer ..... 249/18

FOREIGN PATENT DOCUMENTS

| | | |
|---|---|---|
| DE | 3024580 | 1/1982 |
| DE | 19616876 | 11/1997 |
| DE | 4211200 | 1/2000 |
| DE | 202007002502 | 7/2007 |
| EP | 0297357 | 1/1989 |
| EP | 0573450 | 12/1994 |
| GB | 905408 | 9/1962 |
| GB | 2102870 | 9/1983 |
| WO | WO 9411594 A1 * | 5/1994 |

* cited by examiner

*Primary Examiner* — Michael Safavi
(74) *Attorney, Agent, or Firm* — Volpe and Koenig, P.C.

(57) ABSTRACT

The invention relates to a ceiling formwork (1) having formwork panels (2) comprising rectangular edge webs (3) horizontally disposed in the usage position, and supporting means, such as carriers (15) and/or supports (17) for said formwork panels (2), and a holding element (4) gripping the edge webs (3) of adjacent formwork panels (2) in the corner region, said element comprising centering protrusions (5) for the edge webs (3) of said formwork panels (2) and intersecting openings (6) that are open toward the top, extending horizontally between the centering protrusions (5) in the usage position, which are limited by lateral centering surfaces (7) of the centering protrusions (5). These lateral limitations or centering surfaces (7) of the openings (6) approximate each other from the top to the bottom at least up to a distance from each other that corresponds to the total thickness of two edge webs (3) of in each case two formwork panels (2) in contact with each other in the usage position, wherein a groove-like intermediate space (12) may be provided beneath this closest approximation of the centering surfaces (7) as a continuation of the centering surfaces (7) in order to positively encompass the edges of the edge webs (3) of the formwork panels (2).

13 Claims, 7 Drawing Sheets

CEILING FORMWORK HAVING SUPPORTING MEANS FOR FORMWORK PANELS

BACKGROUND

The invention relates to a ceiling formwork comprising rectangular formwork panels which are arranged horizontally in the position of use and have edge webs and comprising supporting means for these formwork panels and comprising a holding element which takes hold of the edge webs, in contact with one another in the position of use, of adjacent formwork panels in a corner region of the formwork panels.

Ceiling formworks are known in many different forms.

For example, DE 42 11 200 C2 discloses a ceiling formwork in which a holding element is provided for simultaneously taking hold of the four corners of four formwork panels abutting at these four corners. In this case, undercuts are arranged in a longitudinal direction, and specially shaped webs of the formwork panels engage underneath said undercuts in the position of use, which necessitates very specific formwork panels.

The use of formwork panels, for instance, according to DE 20 2007 002 502 or according to EP 0 573 450 B1 would therefore not be possible.

SUMMARY

It is therefore the object to provide a ceiling formwork of the type mentioned at the beginning in which formwork panels having relative simple edge webs, in particular commercially available formwork panels, can be used without the need for undercuts.

To achieve this object, the ceiling formwork defined at the beginning is characterized in that the holding element has centering projections for the edge webs of the formwork panels, and intersecting through-openings running horizontally in the position of use and open toward the top are provided between the centering projections, said through-openings being defined by lateral centering surfaces of the centering projections, and in that the lateral boundaries or centering surfaces of the through-openings approach one another from top to bottom at least until they are at a distance apart which corresponds to the total thickness of two edge webs, in contact with one another in the position of use, of in each case two formwork panels.

The holding element can therefore frictionally take hold of and connect the four corners of the four formwork panels without the need for undercuts. The formwork panels can simply be put with their four corner regions onto the holding element from above, in the course of which a respective centering projection takes hold of a corner, formed by two edge webs, of a formwork panel and engages in this corner, since in each case two edge webs bearing against one another in the corner region in the position of use fit between the centering projections. Since the centering projections have corresponding centering surfaces, the formwork panels are automatically correctly positioned by the fitting, since the abutting formwork panels, when they are being lowered into the position of use on the holding element, are mutually centered and positioned by the centering surfaces and the distance apart thereof. In the process, the respective outer sides of the edge webs of the, for example four, formwork panels come to bear against one another automatically, a roughly cross-shaped parting seam being formed between them, which, however, is so narrow that virtually no concrete can penetrate.

It is expedient in this case if the centering projections are arranged on a plate which closes the horizontal through-openings at the bottom and serves as seating, in the position of use, for those edges of the edge webs of the formwork panels which are remote from the facing. The top end faces of the centering projections could certainly also support the formwork panels on the underside of the facing, but this possibly would not result in a sufficiently steady transmission of force. By means of said measure to use the plate having the centering projections for seating the edge webs, good introduction of the forces occurring during the concreting is obtained. The centering projections are of course in this case only dimensioned to be so tall that they do not touch or scarcely touch the outer side of the facing.

An especially favorable configuration of the invention can provide for the centering surfaces of the centering projections, at the point at which they come closest to one another, to merge into vertical boundaries of groove-like spaces between the centering projections, the clear width of which spaces corresponds to the thickness of two edge webs bearing against one another, wherein the groove-like spaces form the lower region of the through-openings in the position of use. In this way, the edge webs of the formwork panels can be enclosed in a positive-locking manner by the through-openings over a certain width and can thus be secured even more effectively. Good positive locking between the formwork panels and the holding element with its centering projections is obtained in this way in particular in the horizontal direction. During the fitting, the formwork panels can slide with the edge webs along the centering projections and can then enter the groove-like spaces, such that they have a stable and defined position in particular after the fitting of all four formwork panels supported on such a holding element, in which position the facings of these formwork panels also lie in a corresponding plane on account of the corresponding dimensioning of the edge webs.

In this way, at least one section of the edge webs of the formwork panels, in the position of use, can be held in a sliding or press fit in the through-opening accommodating them and in the groove-like spaces of the latter. A sliding fit has the advantage of the slightly larger tolerances; a press fit has the advantage of greater stability of the mutual securing.

Since the coinciding corners of four formwork panels bearing against one another are to be taken hold of, four centering projections are in each case expediently arranged at distances from one another, which form the through-openings, and two centering surfaces can be provided on each centering projection, the cross sections of said centering surfaces running at right angles to one another and parallel to the cross sections of centering surfaces of adjacent centering projections. Therefore each centering projection, in the corner region of a formwork panel, can act upon the edge webs running at right angles to one another toward this corner and as a result can then not only support but also hold together the four formwork panels in the desired manner. This helps to insert the formwork panels because the centering projections can taper upwards in the region of their centering surfaces and in the region of the transition surfaces arranged in the region between the two centering surfaces. The formwork panels are therefore automatically oriented.

All the centering projections can have a corresponding shape and corresponding dimensions, and respectively adjacent centering projections can each be arranged in such a way as to be rotated by 90° relative to one another and directed upward in the position of use. Therefore the centering projections match the respective corners, formed by edge webs, of formwork panels, and a certain formwork panel need not be assigned to a certain centering projection.

A connecting surface can be provided between two centering surfaces of a centering projection on the side facing approximately the center of the holding element, and this connecting surface is flat or crowned and leaves free, in the position of use, the inner edge of the corner, formed by two edge webs, of the formwork panel acting on this centering projection. This results firstly in a saving of material on the centering projections and secondly also makes it easier to place the formwork panels, in which the corner region of the edge webs could possibly be slightly rounded.

It may be mentioned that the centering surfaces could also be flat, curved or crowned, and also the cross section of the centering surfaces could be rectilinear or curved parallel to the formwork panels or to the holding plate.

An expedient embodiment which effectively forms the obliquely running centering surfaces arranged in right-angled planes relative to one another can provide for the centering projections to each be a quarter of a pyramid which is divided at right angles to the boundaries of its base area, the remaining pyramid surface parts forming the centering surfaces, the edges that run between these pyramid lateral surface parts preferably being rounded off or chamfered in order to form the abovementioned transition surface between the two centering surfaces.

This results in robust centering projections which have the desired shape tapering substantially from the bottom to the top and have the desired extent at their base, where the greatest forces can also occur.

An important and advantageous configuration of the invention can provide for in particular downwardly projecting coupling means for connecting to supporting means of the formwork to be provided on the underside of the holding element and/or of the plate belonging to the said underside or at the edge of this plate. In this way, the holding element can be connected and coupled to girders, supports or other supporting means in order to be able to absorb and dissipate the forces transmitted from the formwork panels to the holding element.

It is expedient in this case if a holding opening open toward the bottom and running horizontally in the position of use is provided on the underside of the holding element and/or of its plate, the clear width of said holding opening corresponding approximately to the width of a formwork girder of the ceiling formwork. The holding element can therefore be put down on a formwork girder by the holding opening accommodating the top side of this formwork girder and enclosing at least part of the formwork girder.

The holding opening arranged on the underside of the holding element can be defined and formed by two parallel flanges or legs or straps or profiles, it being possible for the width of the underside holding opening to be dimensioned in such a way that there is a sliding or press fit with the supporting means of the formwork or with the formwork girder in the position of use. It is therefore sufficient to put the holding element with its underside holding opening onto such a formwork girder and enclose the latter at the same time with the holding opening in order to render the holding element effective in a desired position and possibly also secure it frictionally by a press fit. This advantageously permits an infinite adjustment or setting of the holding element relative to a formwork girder.

However, at least one projection may also be provided as underside coupling means on the underside of the holding element or of its plate, said projection fitting together with the top end of a commercially available support. In many cases, ceiling formworks have supports as supporting means for the formwork panels and the holding elements thereof, such that, given a corresponding configuration of the underside of the holding element, coupling to such a support is also possible, which may be suitable, for example, for overlapping the top support end.

In this case, a projection which fits into an end-face opening of a commercially available formwork support, in particular in such a way as to fill at least a region of the latter, may be arranged as coupling means on the underside of the holding element. As a rule, such supports have, at their top end, end-face openings which can be utilized according to the invention by the holding element fitting with its underside projection into this opening and therefore permitting simple connection and coupling to the support.

The projection on the underside of the holding element may be a socket or a round piece, the external dimension of which corresponds approximately to the internal dimension of a conventional circular hole or opening at the top of a formwork support and in particular fits in a clamping manner into this hole. Such a coupling of round cross section on the underside of the holding element can be combined especially easily with correspondingly shaped holes on supports and also enables the holding element to be rotated relative to the support if this should be necessary. In addition to or instead of the coupling means already mentioned, legs, straps or suchlike fastening elements or holes for attaching fastening elements such as screws, bolts, rivets or the like could be provided on the holding element and/or its plate or on the projections referred to if especially tight and locally predetermined fixing of the holding element is desired.

The holding element is expediently made of metal or rigid plastic and at least the centering projections and the plate can be in one piece with one another, which gives the holding element especially high strength.

An especially expedient configuration of the invention can provide for the coupling means to be designed in such a way that the holding element can be attached in a vertically adjustable manner to the supporting means of the formwork. As a result, the ceiling formwork can be adapted in its height and oriented in a level position in a desired or requisite manner.

The coupling means for the vertically adjustable holding element can be a threaded bolt which in particular is arranged centrally on the underside of the holding element or its plate and with which preferably a mating thread or a nut rotatable relative to the support meshes. Either the holding element could be rotated with its coupling means, designed as a threaded bolt, for the vertical adjustability or the nut referred to could be rotated for infinite adjustability, while the holding element remains fixed, but is displaced axially as a result.

An additional or modified possibility of connecting the holding element to supporting means of the formwork can consist in the fact that the holding element has holes for fastening screws. It can thus be fastened to a mating plate in a flange-like manner. Just one hole may be sufficient in this case.

In particular in a combination of one or more of the features and measures described above, a ceiling formwork is obtained in which in each case four formwork panels can be taken hold of and supported together in a horizontal position bearing against one another, the fitting thereof being very simple since they can be centered and adapted to one another on the holding element virtually automatically. All four formwork panels can in this case be simply lowered down onto the holding element without undercuts having to be taken into account.

BRIEF DESCRIPTION OF THE DRAWINGS

Exemplary embodiments of the invention are described in more detail below with reference to the drawing, in which, partly in schematic illustration.

DETAILED DESCRIPTION OF THE PREFERRED EMBODIMENTS

Figure 2:
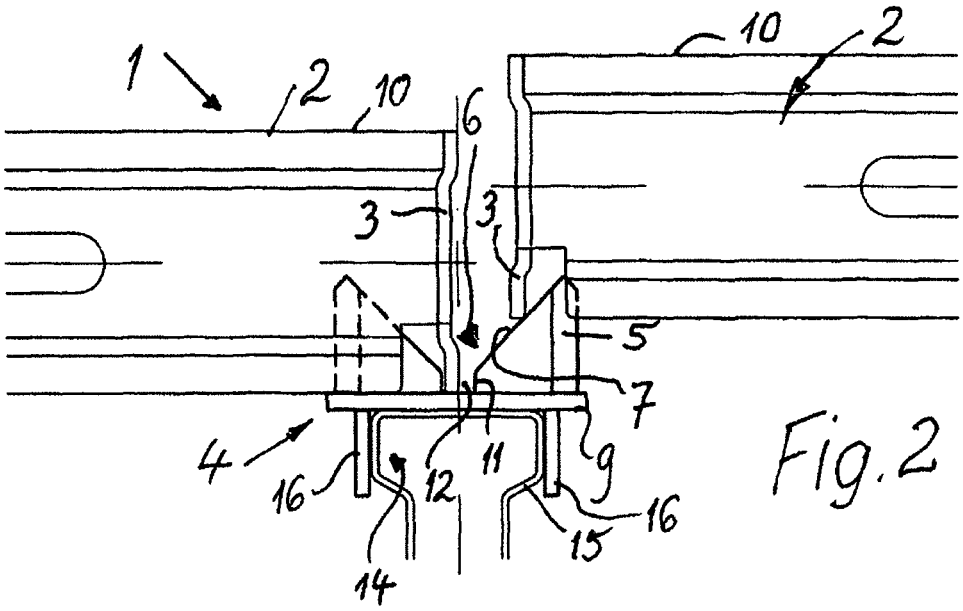
FIG. 2 shows that region of the ceiling formwork that can be seen in FIG. 1 as viewed from the side, wherein one formwork panel is already located in a centered position of use and a neighboring formwork panel is just being lowered into this position of use and is at the same time being guided downward on a centering surface with the edge web to be taken hold of, FIG. 3 shows a cross section, along section line A-A in FIG. 4, of a holding element which belongs to the ceiling formwork according to the invention and is coupled to a girder supporting it.

In the description below, objects and parts corresponding with regard to their function are given corresponding reference numerals even in the case of modified fashioning.

Figure 1:
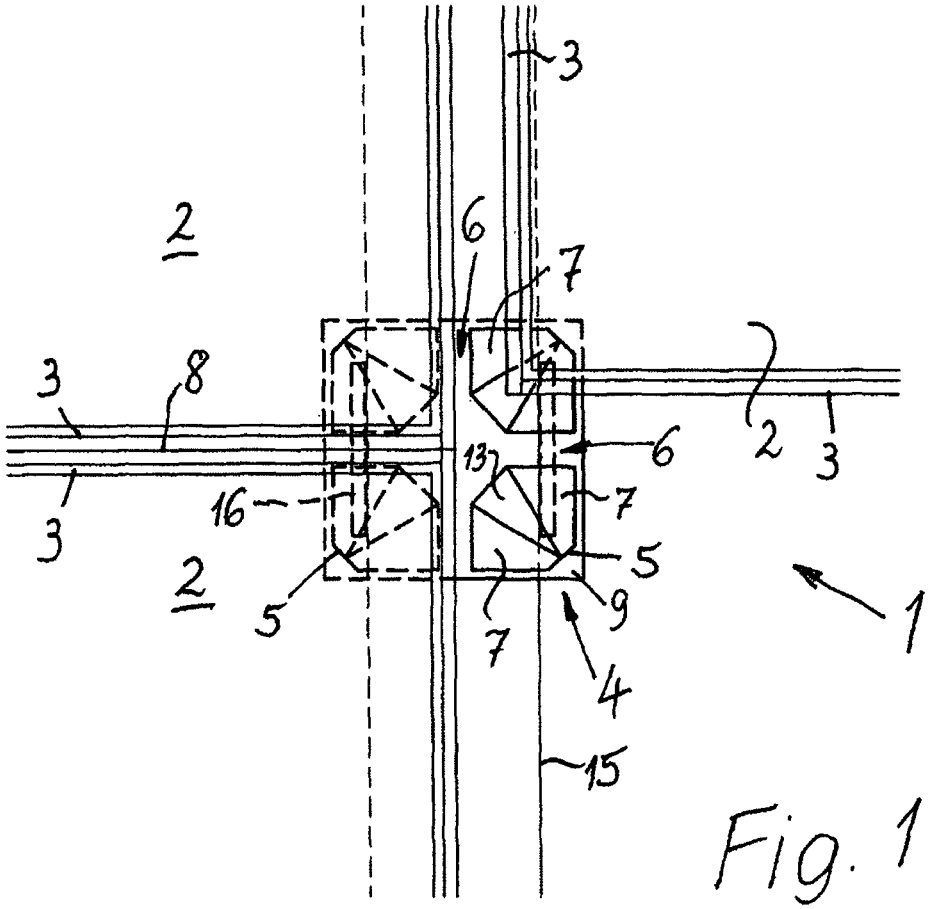
FIG. 1 shows a plan view of a ceiling formwork shown partly in the region of a supporting system, wherein two formwork panels with their edge webs and corner regions have already been taken hold of on a holding element, a third formwork panel is being lowered on the holding element and the fourth formwork panel for the supported intersection is omitted.
Figure 3:
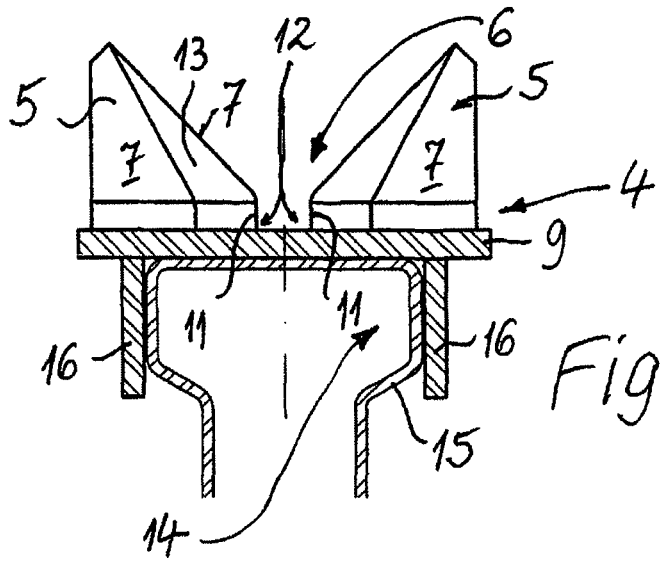

According to FIGS. 1 and 2, a ceiling formwork designated overall by 1 and shown only partly in plan view in FIG. 1 has rectangular formwork panels 2, arranged horizontally in the position of use and having edge webs 3, and supporting means (still to be described), which are of different configuration in the various exemplary embodiments and are intended for these formwork panels 2, and one or more holding elements 4 which take hold of the edge webs 3, which are in contact with one another in the position of use, in the corner regions of the formwork panels 2.

It can be seen in particular in FIGS. 1 and 2 how such a holding element 4 supports the four formwork panels 2, such that the latter bear against one another in their corner regions in the position of use and are in contact with one another in a sealing manner, the seam which runs between them being of cross-shaped configuration.

So that the insertion of the formwork panels 2 is simple and the formwork panels 2 are centered and positioned virtually automatically, each holding element 4 according to FIGS. 1, 4, 6, 7 and 10 has four centering projections 5, which, according to FIG. 2 and also according to FIG. 1, interact with the edge webs 3 of the formwork panels 2 and guide the latter into their position of use when the formwork panels 2 are placed and lowered, as shown in particular in FIG. 2.

It can be seen here in FIGS. 2, 3, 5, 8, 9, 11 and 12 that through-openings 6 running horizontally in the position of use, intersecting one another according to the other figures and open toward the top are provided between the centering projections 5 and are defined by lateral centering surfaces 7 of the centering projections 5, the lateral boundaries or centering surfaces 7 of these through-openings 6 approaching one another from top to bottom at least until they are at a distance apart which corresponds to the total thickness of two edge webs 3, in contact with one another in the position of use, of in each case two formwork panels 2 when the latter bear against one another in the position of use according to FIG. 1.

It can be seen in FIG. 2 that the through-opening 6 is half filled at the bottom end by the edge web 3 of the already lowered formwork panel, such that the edge web 3 of the formwork panel just being lowered still fits into the through-opening 6, as a result of which the latter is then completely filled, such that at the same time the edge webs 3 of the formwork panels 2 also bear tightly against one another.

Since, according to FIG. 1, the respective corner regions of a total of four formwork panels adjacent to one another are taken hold of in this way by the four centering projections 5, the seams 8, intersecting at this point, of the formwork panels 2 are in each case tightly held together.

In all the exemplary embodiments, the centering projections 5 are arranged on a square plate 9 which closes the through-openings 6 at the bottom and serves as seating, in the position of use, for those edges of the edge webs 3 which are remote from the facing 10 of the formwork panels 2, as can readily be seen in FIG. 2. The plate 9 could also be rectangular or round.

In this case, the centering surfaces 7 of the four centering projections 5, at the point at which they come closest to one another, which corresponds to the total thickness of two edge webs 3, merge into vertical boundaries 11 of groove-like spaces 12 between the centering projections 5, the clear width of which spaces 12 likewise corresponds to the thickness of two edge webs 3 bearing against one another, wherein the groove-like spaces 12 form the lower region of the through-openings 6 in the position of use, that is to say they belong to said through-openings 6. The edges of the formwork panels 3 are therefore secured to the holding elements 4 in a defined manner.

Figure 4:
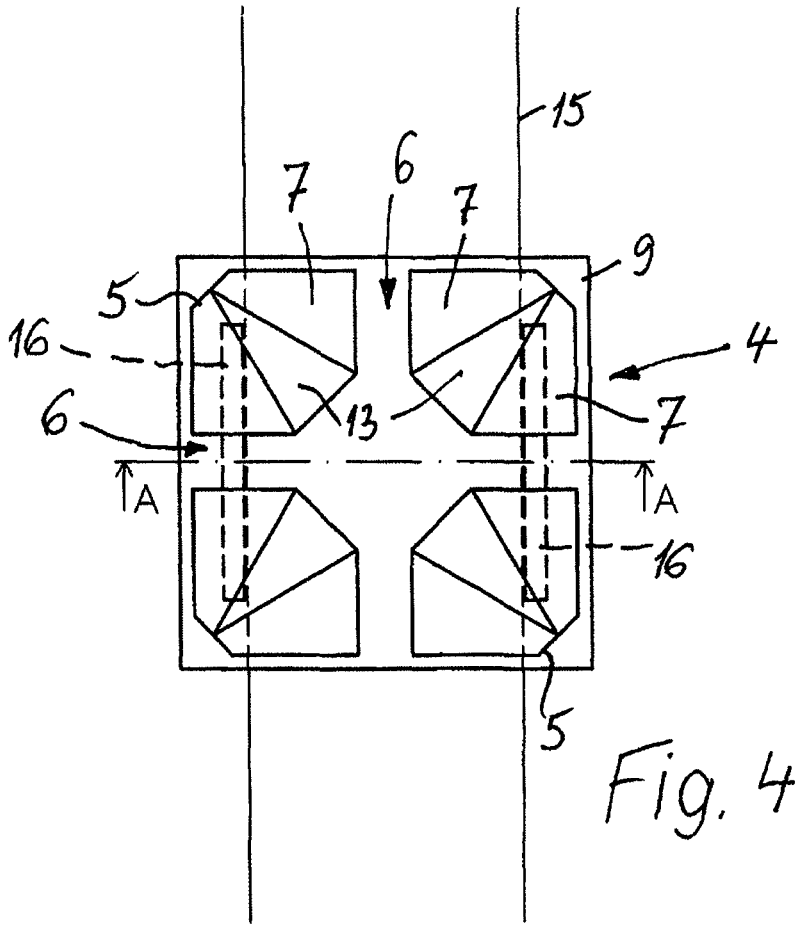
FIG. 4 shows a plan view of the holding element shown in FIG. 3.
Figure 5:
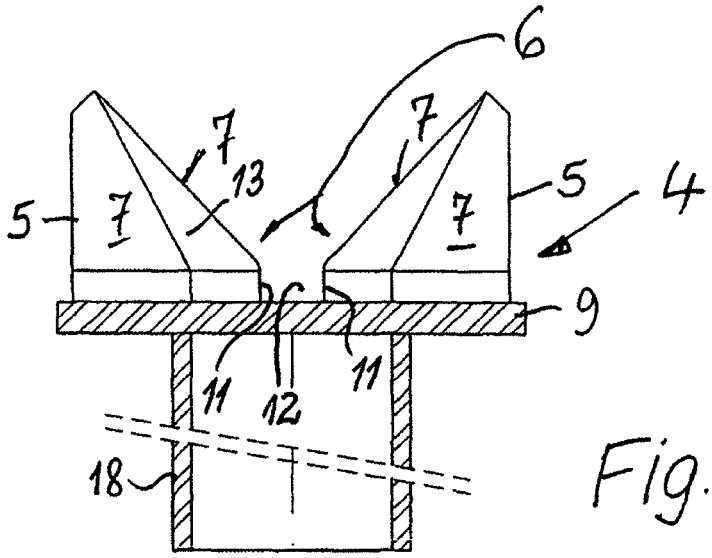
FIG. 5 shows an illustration corresponding approximately to FIG. 3, a pipe socket being provided as coupling means on the underside of the holding element, along section line A-A in FIG. 6.
Figure 6:
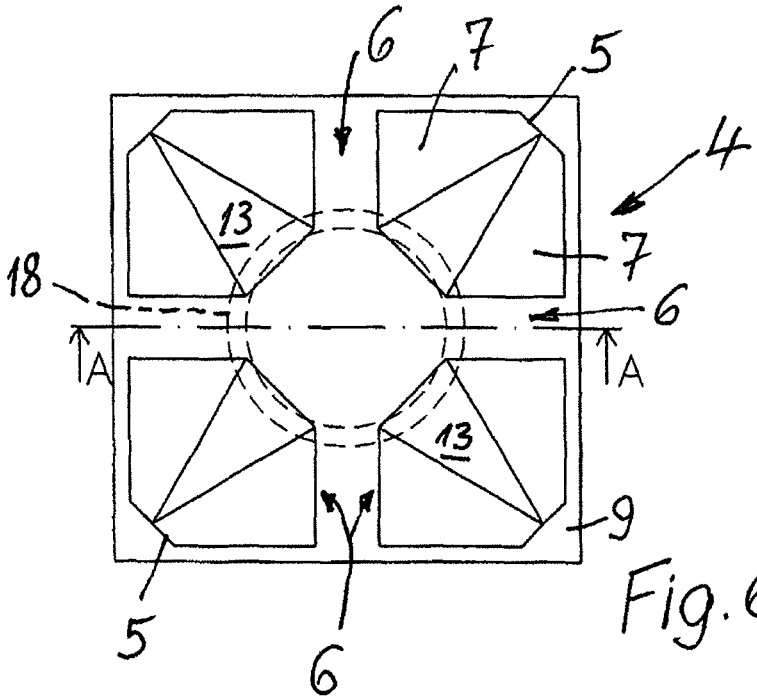
FIG. 6 shows a plan view of the holding element according to FIG. 5.
Figure 7:
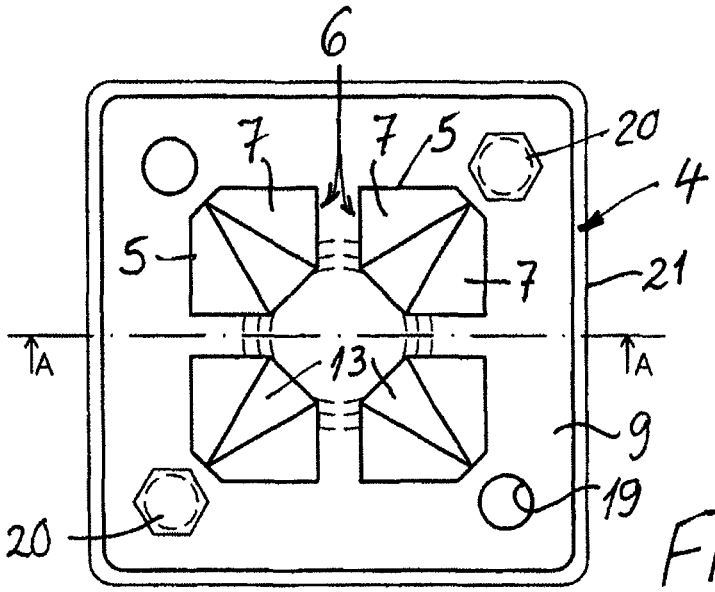
FIG. 7 shows a plan view of a modified holding element in which a plate carrying the centering projections is designed as a flange-like plate and has holes for screws or bolts for coupling to a mating plate.
Figure 10:
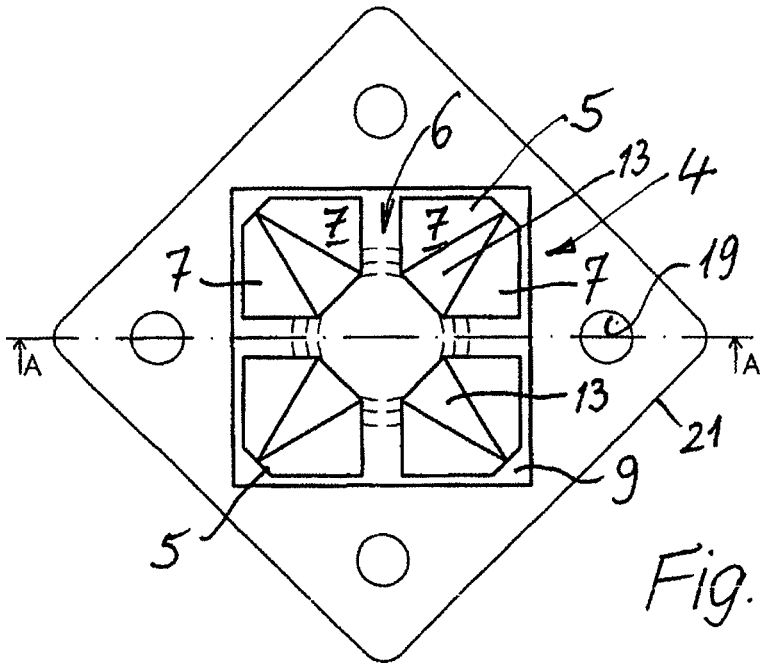
FIG. 10 shows an exemplary embodiment of a holding element in plan view, beyond which a mating plate arranged under it projects laterally.

Since the ceiling formwork 1 is formed with rectangular formwork panels 2, all four centering projections 5 have a corresponding shape and corresponding dimensions, and respectively adjacent centering projections 5 are each arranged on the plate 9 in such a way as to be rotated by 90° relative to one another and directed upward in the position of use, as can clearly be seen, for example, in FIG. 4 or 7 or 10.

According to FIG. 2, a section of the edge webs 3 of the formwork panels 2, in the position of use, is held in a press fit in the through-opening 6 accommodating them, and in particular in the groove-like spaces 12 of the latter, in order to achieve tightness between the individual edge webs 3 against the penetration of concrete. The holding element, with its centering projections 5, therefore has the additional function of also holding the formwork panels 3 of the ceiling formwork 1 fixedly against one another at the respective intersections.

The four centering projections 5 are therefore in each case arranged at a distance from one another, which forms the through-openings 6 and the spaces 12, and two centering surfaces 7 are provided on each centering projection 5, the cross sections of said centering surfaces 7, on such a centering projection 5, running at right angles to one another in view of the rectangular shape of the formwork panels and parallel to the cross sections of centering surfaces 7 of adjacent centering projections 5.

It can be seen in the plan views of the holding element 4 that a connecting surface 13 is provided between two centering surfaces 7 of each centering projection 5 on the side facing approximately the center of the holding element 4, and this connecting surface 13 may be flat or crowned and leaves free, in the position of use, the inner edge of the corner of the formwork panel 2 acting on this centering projection 5. The corners of the formwork panels 2 accordingly fit satisfactorily onto these centering projections 5, and weight can also be saved in this way. Geometrically, the centering projections 5 can also each be regarded as a quarter of a pyramid which is divided at right angles to the boundaries of its base area, such that the respectively remaining pyramid surfaces form parts of the centering surfaces, in which case the edges running between these pyramid lateral surface parts are rounded off or chamfered as connecting surfaces. In addition, the four quarters of a pyramid which are produced in this way are rotated by 90° relative to one another and thereby have the position relative to one another shown in the exemplary embodiment, such that the pyramid surface parts can serve as centering surfaces 7.

The holding element 4 can be connected to supporting means of the formwork in different ways. Here, in all the exemplary embodiments, at least one downwardly projecting coupling means, still to be described below with reference to the different exemplary embodiments, for connecting to the different supporting means of the formwork is provided on the underside of the holding element 4 and of the plate 9 belonging to the latter.

In the exemplary embodiment according to FIGS. 1 to 4, a holding opening 14 open toward the bottom and running horizontally in the position of use is provided on the underside of the holding element 4 and of its plate 9, the clear width of said holding opening 14 corresponding approximately to the width of a formwork girder 15 belonging to the ceiling formwork 1. In this case, this holding opening 14 arranged on the underside of the holding element 4 and of the plate 9 is defined and formed in the exemplary embodiment by two parallel straps 16, but could also be arranged between two parallel flanges or legs or profiles. The clear width of this underside holding opening 14 is in this case dimensioned in such a way that there is at least one sliding fit or preferably a press fit with the supporting means or formwork girder 15 in the position of use, this arrangement having the advantage that the holding element 4 can be arranged in different positions relative to the girder 15.

According to FIGS. 5 to 8 and 11, a projection may also be provided as coupling means on the underside of the holding element 4 and of its plate 9, said projection fitting together with the top end of a commercially available support 17 that belongs to the formwork 1 and being designed in the exemplary embodiment as a round piece or pipe socket 18. The latter can fit with clearance or if need be in a clamping manner in a conventional circular hole at the top of a formwork support 17.

Figure 8:
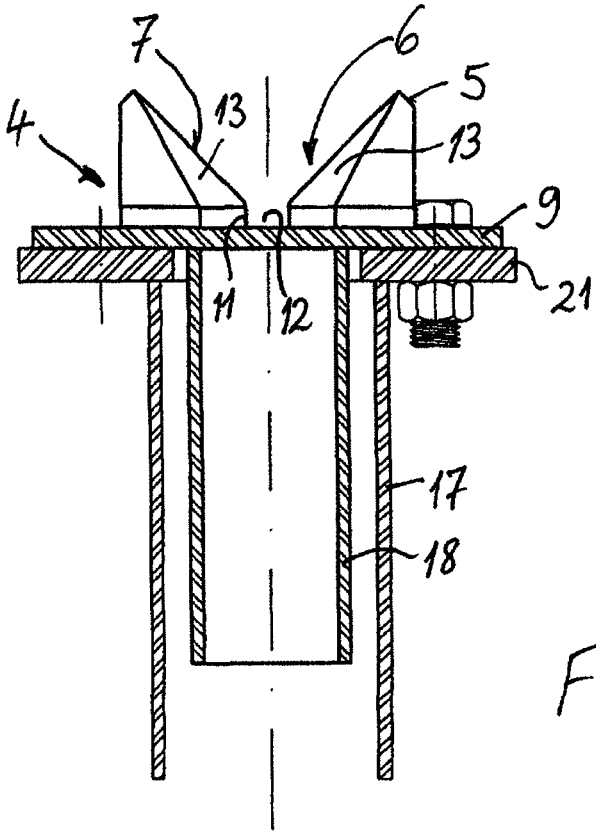
FIG. 8 shows a longitudinal section of the holding element along section line A-A in FIG. 7, wherein a screw, serving for coupling to a mating plate on a support, and a pipe socket can be seen.
Figure 9:
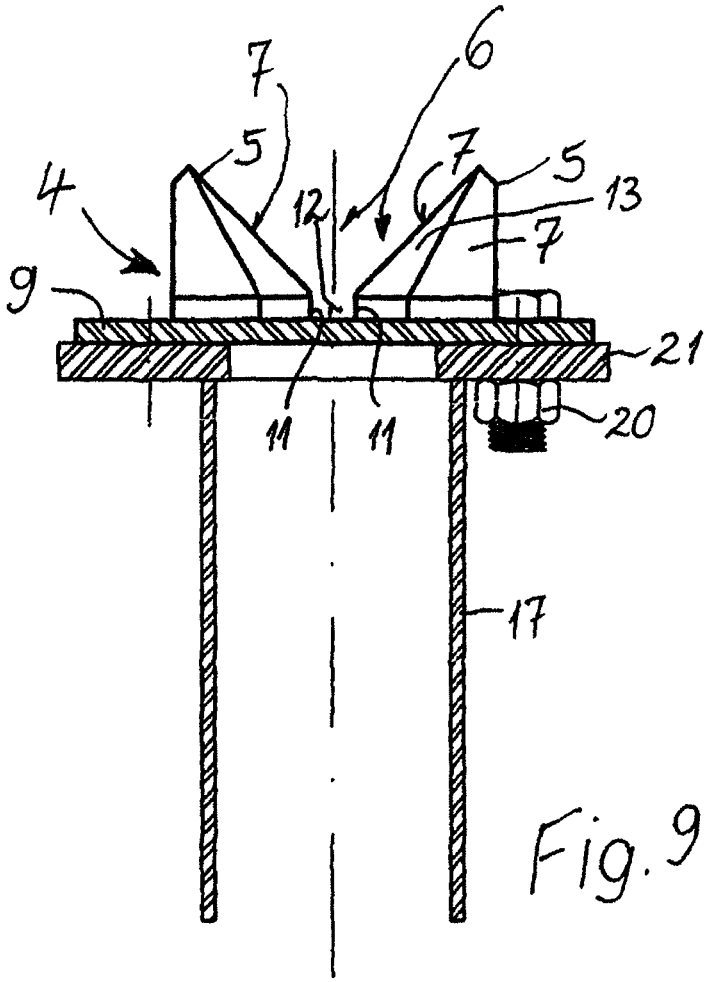
FIG. 9 shows a section corresponding to FIG. 8, wherein the holding element does not have a pipe socket on its underside, but rather only a screwed connection is provided for coupling to a mating plate.

Shown in FIGS. 7 and 9 is an exemplary embodiment in which the coupling means for the holding element is formed by holes 19, passing through the holding plate 9, for fastening screws 20. In this case, the support 17 has at its top end an end plate 21 with matching holes, so that the fastening according to FIGS. 7 and 9 is possible. FIG. 8 shows that this can be combined with the arrangement of a pipe socket 18 on the underside of the plate 9.

Figure 11:
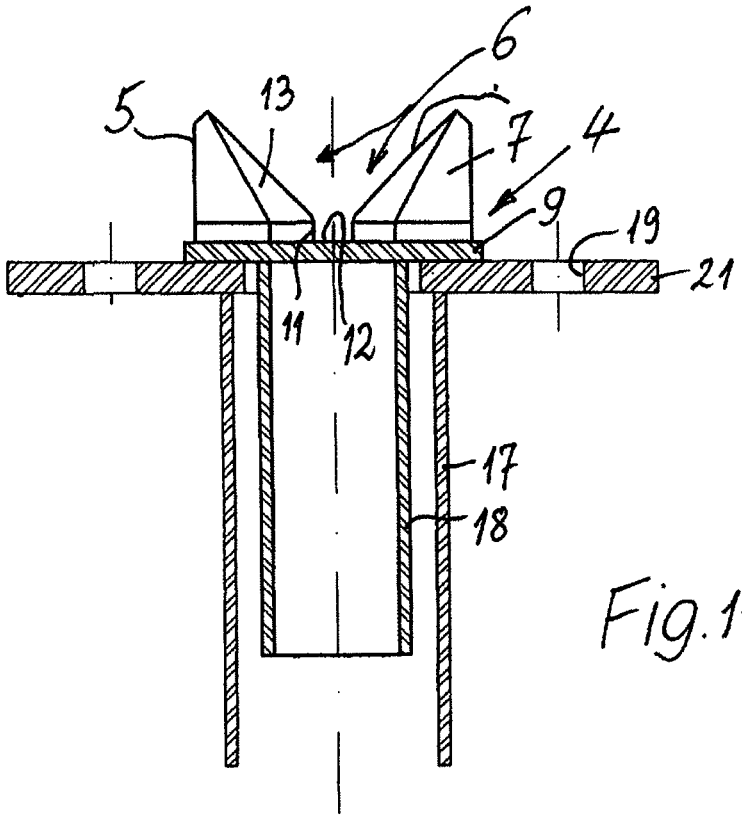
FIG. 11 shows a longitudinal section of the arrangement along section line A-A in FIG. 10, the holding element having a pipe socket on the underside as coupling means.

FIGS. 10 and 11 show an arrangement in which the pipe socket 18 again engages in the support 17, which has an end plate 21 with fastening holes 19, although the plate 9 is arranged between these holes 19.

Figure 12:
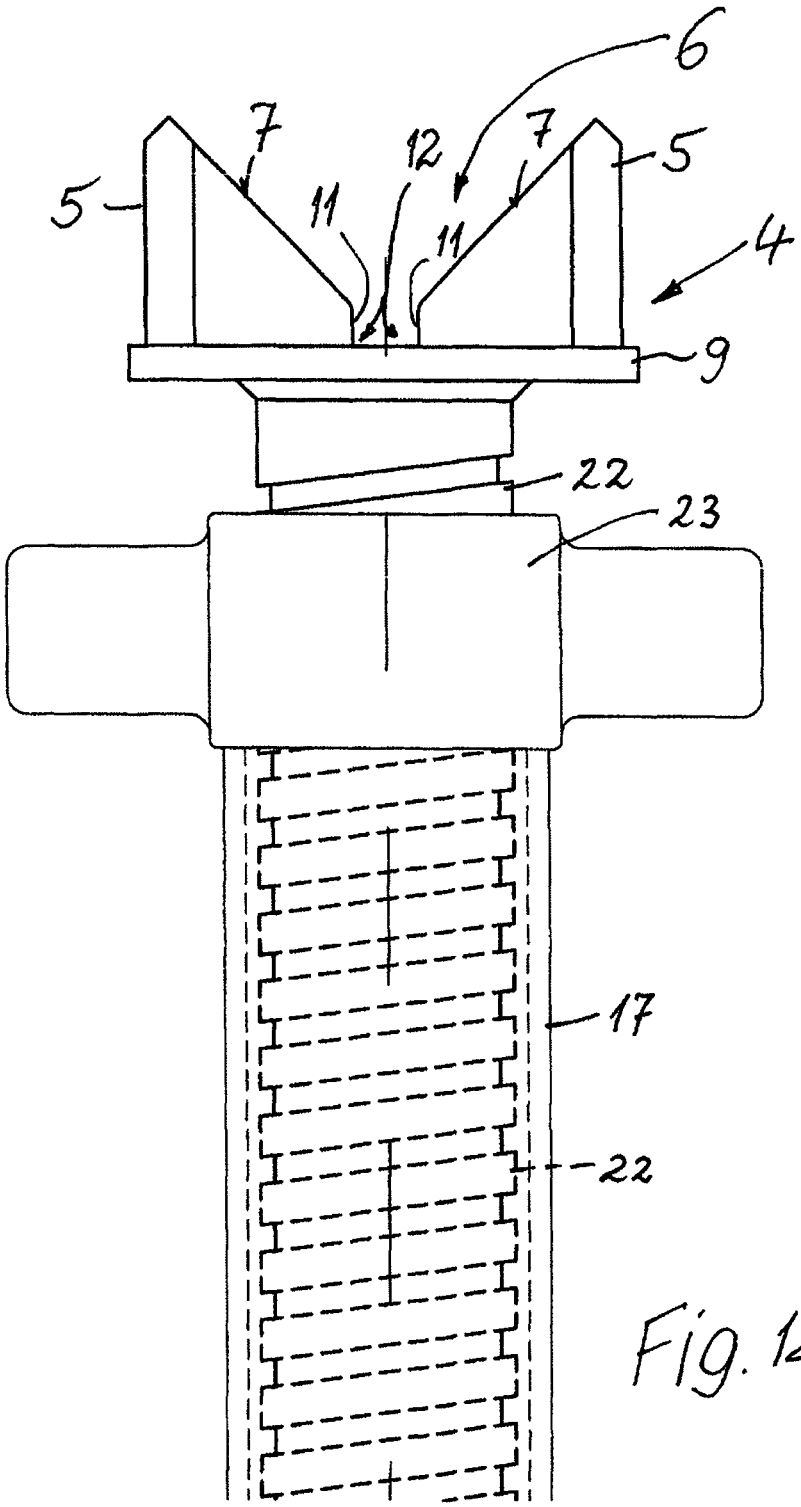
FIG. 12 shows an embodiment in which the coupling means on the underside of the plate of the holding element is a threaded bolt for a vertical adjustment of the holding element.

FIG. 12 shows an exemplary embodiment in which the coupling means of the holding element 4 is designed in such a way that said holding element 4 can be attached in a vertically adjustable manner to a supporting means, preferably to a support 17 of the formwork 1. It can be seen that, in this case, the coupling means for the vertically adjustable holding element 4 is a threaded bolt 22 which is arranged centrally on the underside of the holding element 4 or its plate 9 and with which a mating thread, in the exemplary embodiment a nut 23 rotatable relative to the support 17, meshes. If the nut 23 is rotated, the holding element 4 can be raised or lowered via the threaded bolt 22 in order to vertically adjust the formwork panels to be taken hold of by this holding element 4.

The ceiling formwork 1 has rectangular formwork panels 2, arranged horizontally in the position of use and having edge webs 3, and supporting means such as girders 15 and/or supports 17 for these formwork panels 2 and a holding element 4 which takes hold of the edge webs 3 of adjacent formwork panels 2 in the corner region and which has centering projections 5 for the edge webs 3 of these formwork panels 2 and, between the centering projections 5, intersecting through-openings 6 which run horizontally in the position of use, are open toward the top and are defined by lateral centering surfaces 7 of the centering projections 5. These lateral boundaries or centering surfaces 7 of the through-openings 6 approach one another from top to bottom at least until they are at a distance apart which corresponds to the total thickness of two edge webs 3 of in each case two formwork panels 2, wherein, at the point at which the centering surfaces 7 come closest to one another, a groove-like space 12 can be provided as a continuation of the centering surfaces 7 for enclosing the edges of the edge webs 3 of the formwork panels 2 in a positive-locking manner.

The invention claimed is:

1. A ceiling formwork (1) comprising rectangular formwork panels (2) which are arranged horizontally in a position of use and have edge webs (3) and comprising supports for the formwork panels (2) and comprising a holding element (4) which engages the edge webs (3) of adjacent ones of the formwork panels (2) in contact with one another in the position of use, in a corner region of the formwork panels (2), the holding element (4) has centering projections (5) for the edge webs (3) of the formwork panels (2), and intersecting through-openings (6) that extend horizontally in the position of use and open toward the top are provided between the centering projections (5), said through-openings (6) being defined by lateral centering surfaces (7) of the centering projections (5), the centering surfaces (7) of the through-openings (6) approach one another from top to bottom at least until they are at a distance apart which corresponds to a total thickness of two of the edge webs (3), that are in contact with one another in the position of use, of two of the formwork panels (2), and the centering projections (5) are each a quarter of a pyramid which is divided at right angles to boundaries of a base area of the pyramid, such that remaining pyramid lateral surface parts form the centering surfaces (7), and an edge that extends between the pyramid lateral surfaces is rounded off or chamfered.

2. The ceiling formwork as claimed in claim 1, wherein the centering projections (5) are arranged on a plate (9) which closes the through-openings (6) at the bottom and serves as seating, in the position of use, for the edges of the edge webs (3) of the formwork panels which are remote from a facing (10) of the formwork panels.

3. The ceiling formwork as claimed in claim 1, wherein the centering surfaces (7) of the centering projections (5), at a point at which they come closest to one another, merge into vertical boundaries (11) of groove-like spaces (12) between the centering projections (5), a clear width of the spaces (12) corresponds to the thickness of the two edge webs (3) bearing against one another, wherein the groove-like spaces (12) form a lower region of the through-openings (6) in the position of use.

4. Ceiling formwork as claimed in claim 3, wherein at least one section of the edge webs (3) of the formwork panels (2), in the position of use, is held in a sliding or press fit in the through-openings (6) accommodating them or in the groove-like spaces (12) of the latter.

5. Ceiling formwork as claimed in claim 1, wherein the four centering projections (5) are in each case arranged at distances from one another, which form the through-openings (6), and two of the centering surfaces (7) are provided on each of the centering projections (5), cross sections of said centering surfaces (7) extend at right angles to one another and parallel to cross sections of the centering surfaces (7) of adjacent ones of the centering projections (5).

6. Ceiling formwork as claimed in claim 1, wherein all the centering projections (5) have a corresponding shape and corresponding dimensions, and respectively adjacent centering projections (5) are each arranged in such a way as to be rotated by 90° relative to one another and directed upward in the position of use.

7. The ceiling formwork as claimed in claim 1, wherein a connecting surface (13) is provided between two of the centering surfaces (7) of a centering projection (5) on a side facing approximately a center of the holding element (4), and the connecting surface (13) is flat or crowned and leaves free, in the position of use, an inner edge of the corner of the formwork panel (2) acting on the centering projection (5).

8. The ceiling formwork as claimed in claim 1, wherein a downwardly projecting coupling is provided on an underside of the holding element (4) or of a plate (9) belonging to the latter or at an edge of the plate for connection to the support.

9. The ceiling formwork as claimed in claim 8, wherein a holding opening (14) open toward the bottom and extending horizontally in the position of use is provided on the underside of the holding element (4) or of the plate (9), and a clear width of said holding opening (14) corresponds approximately to a width of a formwork girder (15) of the ceiling formwork (1).

10. The ceiling formwork as claimed in claim 9, wherein the holding opening (14) arranged on the underside of the holding element (4) is defined and formed by two parallel flanges or legs or straps (16) or profiles, the width of the underside holding opening (14) is dimensioned in such a way that there is a sliding or press fit with the support of the formwork or with the formwork girder (15) in the position of use.

11. The ceiling formwork as claimed in claim 8, wherein the coupling is designed in such a way that the holding element can be attached in a vertically adjustable manner to the support of the formwork (1).

12. The ceiling formwork as claimed in claim 11, wherein the coupling for the vertically adjustable holding element (4) is a threaded bolt (22) which is arranged centrally on the underside of the holding element (4) or the plate (9) and with which a mating thread or a nut (23) rotatable relative to the support (17) meshes.

13. The ceiling formwork as claimed in claim 8, wherein the holding plate (9) has holes (19) for fastening screws (20).

* * * * *